US006398604B1

(12) United States Patent
Kawashima et al.

(10) Patent No.: US 6,398,604 B1
(45) Date of Patent: Jun. 4, 2002

(54) COMBINATION OF STRAP AND BUCKLE FOR DIVING FINS

(75) Inventors: Haruo Kawashima; Masaji Fujiwara, both of Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 09/936,568

(22) PCT Filed: Jan. 17, 2001

(86) PCT No.: PCT/JP01/00264

§ 371 (c)(1),
(2), (4) Date: Sep. 14, 2001

(87) PCT Pub. No.: WO01/52941

PCT Pub. Date: Jul. 26, 2001

(30) Foreign Application Priority Data

Jan. 17, 2000 (JP) ..... 2000-43489

(51) Int. Cl.[7] ..... A63B 31/08
(52) U.S. Cl. ..... 441/64

(58) Field of Search ..... 441/61, 62, 63, 441/64; D21/806; 280/11.3, 611

(56) References Cited

U.S. PATENT DOCUMENTS 4,795,385 A 1/1989 Matsuoka ..... 441/64
5,657,493 A * 8/1997 Ferrero et al. ..... 2/428

FOREIGN PATENT DOCUMENTS

JP 11-247012 9/1999

* cited by examiner

*Primary Examiner*—Stephen Avila
(74) *Attorney, Agent, or Firm*—Clark & Brody

(57) ABSTRACT

A combination of strap and buckle for diving fins has a heel strap 3 and a buckle 6. The heel strap 3 has first locking teeth 21 formed thereon and a top portion 31 of the buckle 6 has its inner surface facing the heel strap 3 in the vicinity of its rear end formed in its transversely middle zone 39 with a depression hollowed out by a dimension deeper than a height of the first locking teeth 21.

1 Claim, 6 Drawing Sheets

PRIOR ART

COMBINATION OF STRAP AND BUCKLE FOR DIVING FINS

TECHNICAL FIELD OF THE INVENTION

This invention relates to a combination of strap and buckle suitable for diving fins.

RELATED ART

In the accompanying drawings, FIG. 5 is a perspective view showing one of diving fins 101 disclosed in Japanese Patent Publication No. 1989-38510B as partially broken away and FIG. 6 is a sectional view taken along a line VI—VI in FIG. 5. It should be understood here that, in FIG. 6, the buckle 106 made of hard plastic material is shown in a sectional view and a heel strap 103 made of soft rubber is shown in a side view. This buckle 106 serves to connect the strap 103 to a rear end of a foot pocket 102 and to tighten the strap 103 around a fin wearer's heel. The buckle 106 comprises a sheath-shaped first coupling member 104 and a second coupling member 105 wherein the first coupling member 104 is mounted on the rear end of the foot pocket 102. The second coupling member 105 has a insert portion 114 releasably attached to the first coupling member 104 and a holding frame mechanism 115 serving to hold the strap 103 draped around a pin 119 provided in the holding frame mechanism 115 as its component. This holding frame mechanism 115 includes movable locking means 120 supported by a shaft 123 and biased by a spring 128 so as to be rotated clockwise as viewed in FIG. 6. The second coupling member 105 is formed on its lower surface with a second locking tooth 124. The strap 103 draped around the pin 119 of the holding frame mechanism 115 is formed on its one surface with a plurality of first locking teeth 121 arranged in longitudinal direction of the strap 103 so that one of these first locking teeth 121 may bear against the second locking tooth 124 in a direction indicated by an arrow 129 in FIG. 6. The second locking tooth 124 is moved off upward from the first locking tooth 121 as the movable locking means 120 is rotated against the biasing effect of the spring 128. Thereupon, the strap 103 may be pulled in the direction indicated by the arrow 129 to move the strap 103 in a direction in which the strap 103 is slackened. Each of the first locking teeth 121 has an inclined rear surface 121A so that the rear surface 121A causes the movable locking means 120 to float as the strap 103 is pulled in the direction opposite to the direction indicated by the arrow 129. In this way, the strap 103 can be moved in the direction in which the strap 103 is tightened.

In the convention combination of buckle 106 and strap 103 as shown in FIGS. 5 and 6, the rectilinear strap 103 is draped around the pin 119 so as to be forcibly flexed in U- or V-shape. The strap 103 normally tends to restore its initial rectilinear state, i.e., tends to move in a direction indicated by an arrow 140 in FIG. 6. Consequently, one of the first locking teeth 121 bears against a rear end 115A of the holding frame mechanism 115 from the right as viewed in FIG. 6 as the strap 103 is pulled in the direction indicated by the arrow 129 and often prevents the strap 103 from smoothly moving in the direction indicated by the arrow 129. Thus, operation of slackening the strap 103 would take much time.

It is an object of this invention to improve the conventional combination of buckle and strap so that the strap can be smoothly moved and slackened without taking much time and labor.

DISCLOSURE OF THE INVENTION

According to this invention, there is provided a combination of buckle and strap for diving fins adapted to couple a heel strap to a foot pocket and at the same time to adjustably tighten the strap around a diver's heel.

The strap is formed on its one surface a plurality of first locking teeth arranged intermittently in a longitudinal direction of the strap, each of the first locking teeth extending in a transverse direction of the strap so as to leave transversely opposite side edge portions of the strap free from any tooth. The buckle comprises a sheath-shaped first coupling member and a second coupling member releasably engaged with the first coupling member and having front and rear ends, wherein the second coupling member comprises an insert portion formed adjacent the front end so as to be releasably engaged with the first coupling member and a holding frame mechanism formed adjacent the rear end within which the strap is draped around so as to be movable in the longitudinal direction of the strap. The holding frame mechanism includes a movable locking piece pivotally supported by the holding frame mechanism. The movable locking piece has a second locking tooth normally biased by springs to bear against the first locking tooth and thereby to prevent the strap from moving in a direction in which the strap is slackened and pivotally moved upward away from the first locking tooth against the biasing effect of the springs, allowing the strap to move in a direction in which the strap is tightened, as the strap is pulled in the direction in which the strap is tightened. In the vicinity of the rear end, the holding frame mechanism presents an inverted U-shaped section defined by a top portion and a pair of lateral portions depending from transversely opposite side edges of the top portion wherein a pin around which the strap is draped extends between the pair of lateral portions below the top portion and a lower surface of the top portion has transversely opposite side edge portions bears against the strap disposed between the lower surface and the pin so that the transversely opposite side edge portions of the strap extending outside the first locking teeth may slidably move and transversely middle zone of the lower surface of the top portion is hollowed out upward by a dimension deeper than a height of the first locking teeth so that the first locking teeth can move in the longitudinal direction of the strap.

PREFERRED EMBODIMENTS OF THE INVENTION

Details of a combination of buckle and strap according to this invention will be more fully understood from the description given hereunder with reference to the accompanying drawings.

Figure 1:
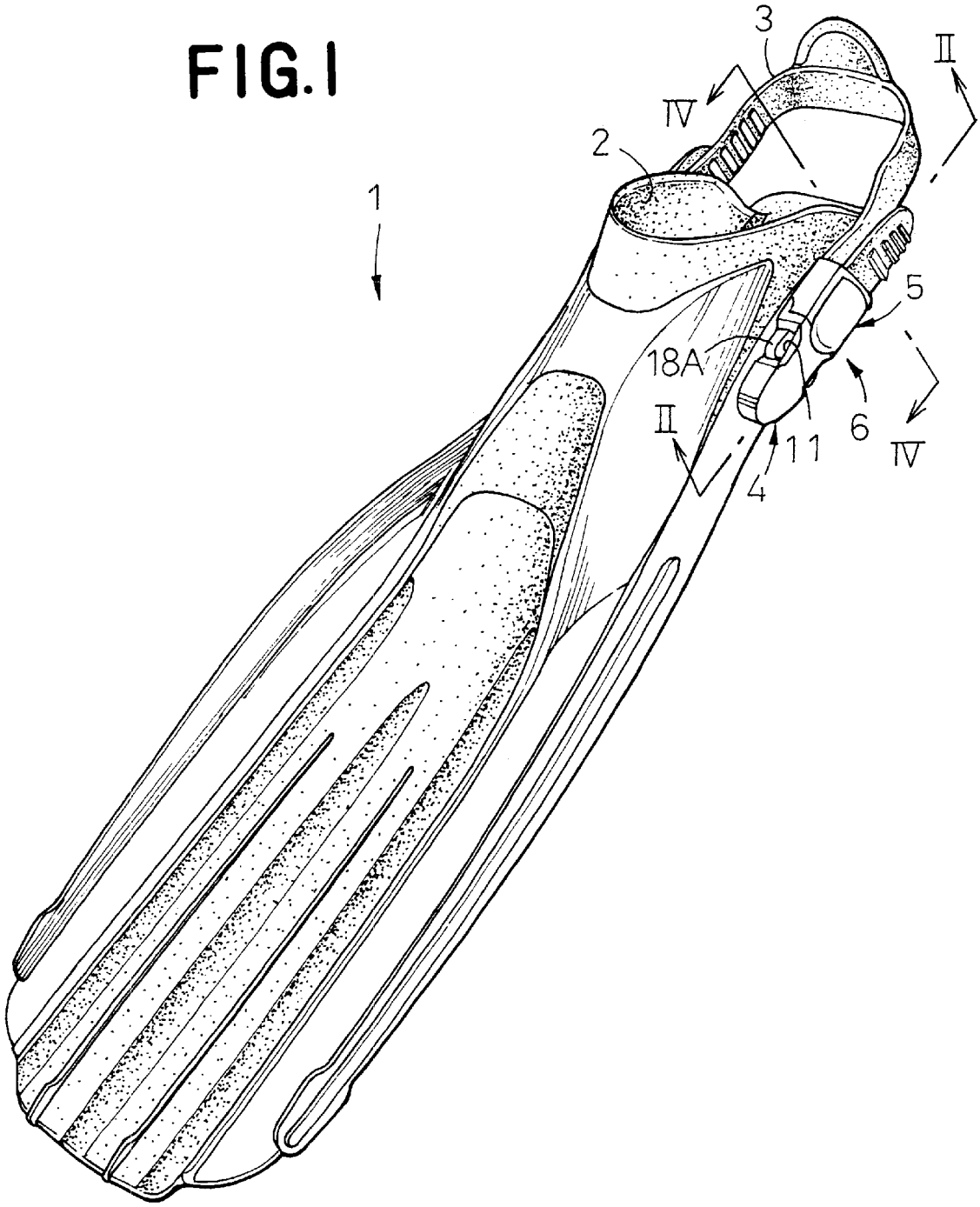
FIG. 1 is a perspective view showing one of paired diving fins.

FIG. 1 is a perspective view showing one of diving fins 1 incorporated with a combination of buckle and strap according to this invention. The fin 1, a strap 3 and a buckle 6 in this embodiment present appearances substantially similar to those in the embodiment of prior art. The combination of buckle and strap basically comprises the strap 3 serving to tighten a fin wearer's heel and the buckle 6 serving to couple the strap 3 to a rear end of a foot pocket 2 of the fin 1. The strap 3 is rectilinear and made of soft rubber material. As shown, the strap 3 is curved to describe a circular arc and has opposite ends draped around the respective buckles 6 so that a length of the strap 3 can be adjusted. The buckle 6 comprises a sheath-shaped first coupling member 4 mounted on the foot pocket 2 and a second coupling member 5 releasably engaged with the first coupling member 4 wherein both of these coupling members 4, 5 are made of hard plastic material.

Figure 2:
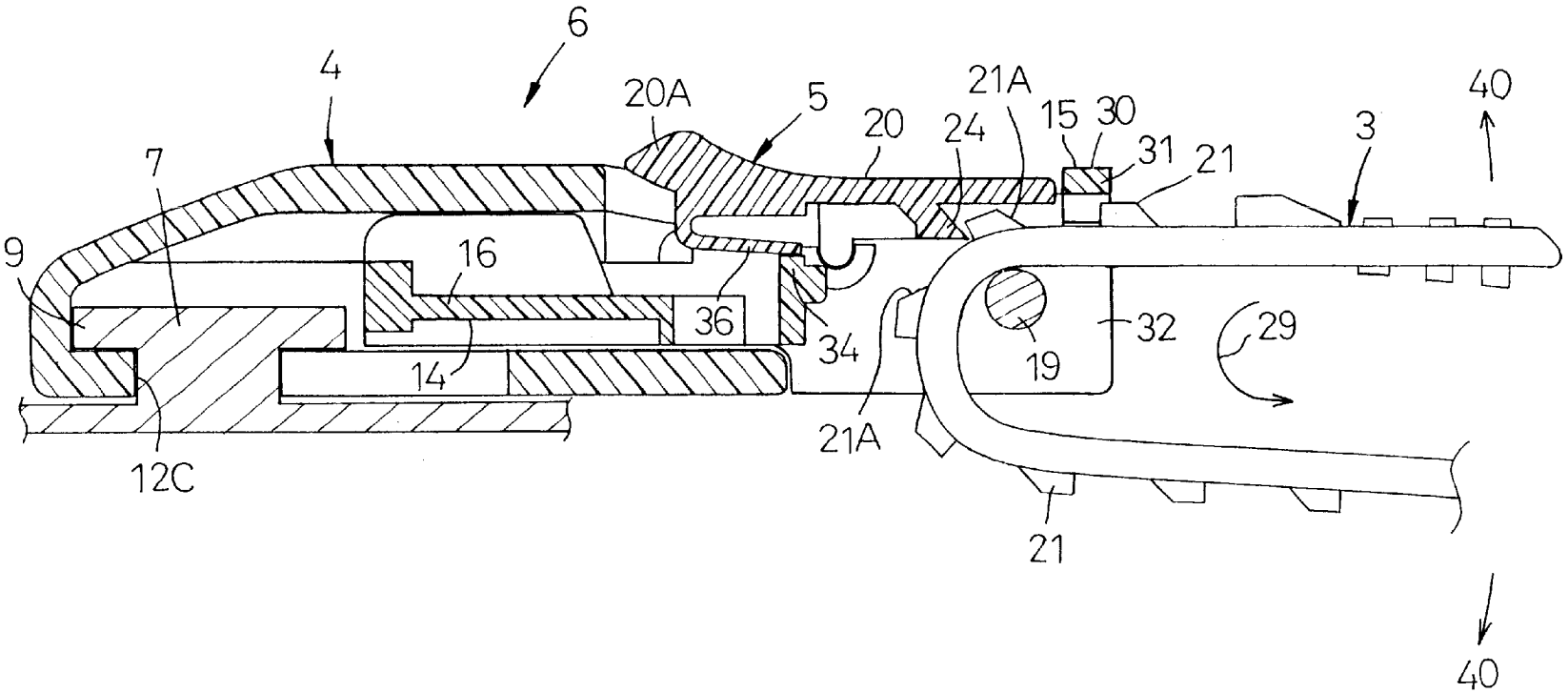
FIG. 2 is a sectional view taken along a line II—II in FIG. 2.
Figure 3:
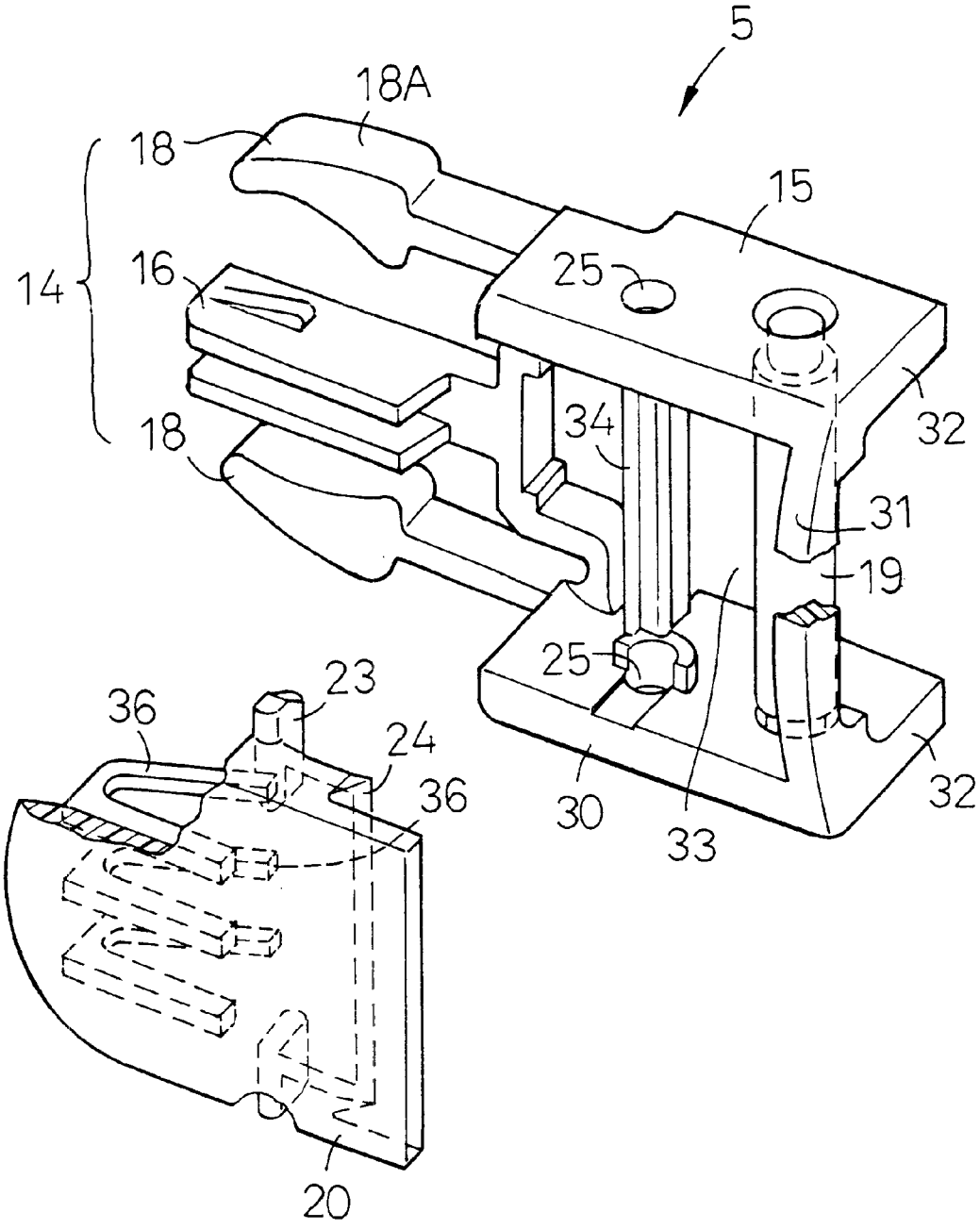
FIG. 3 is an exploded perspective view of a second coupling member.
Figure 5:
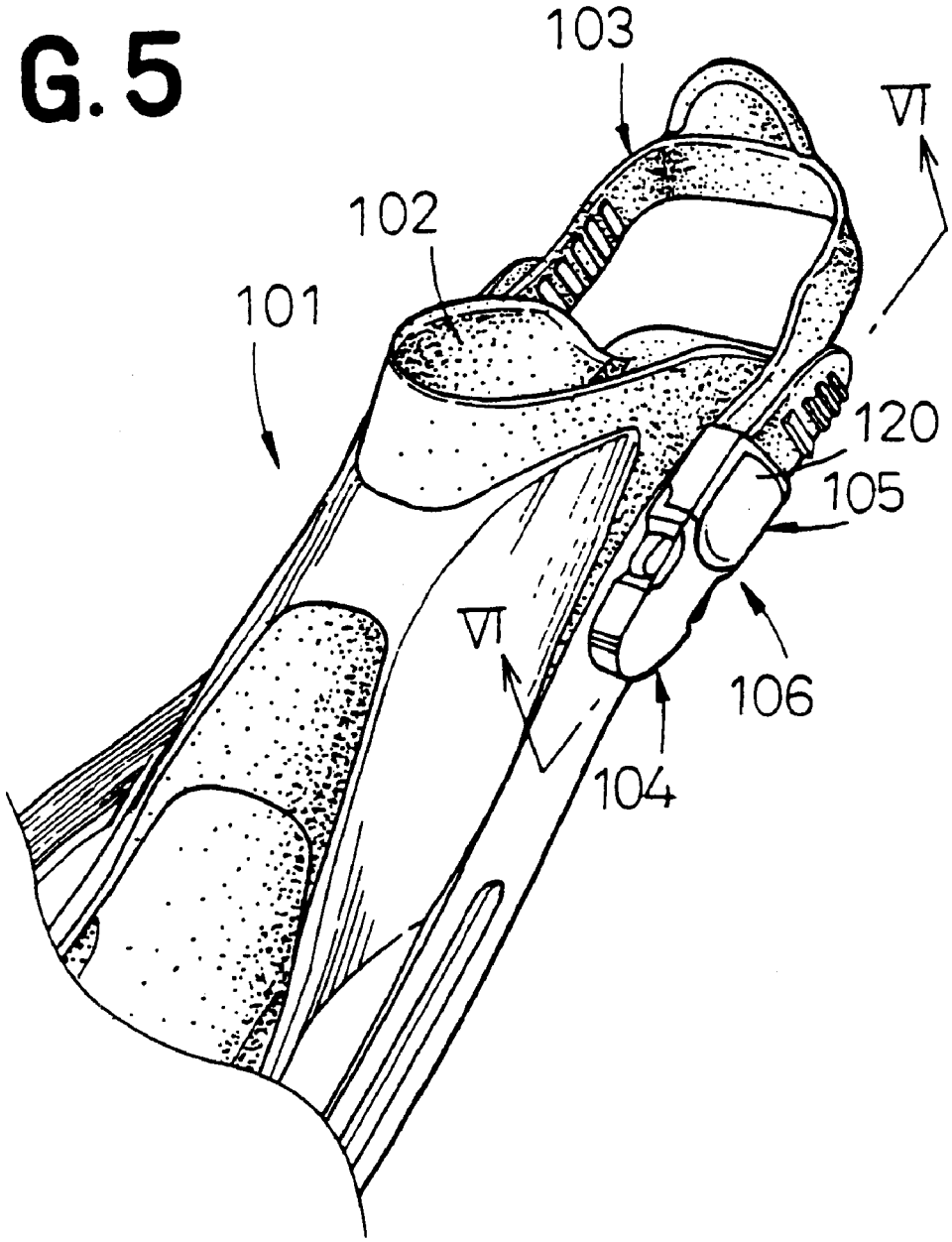
FIG. 5 is a perspective view showing one of the diving fins of prior art as partially broken away.
Figure 6:
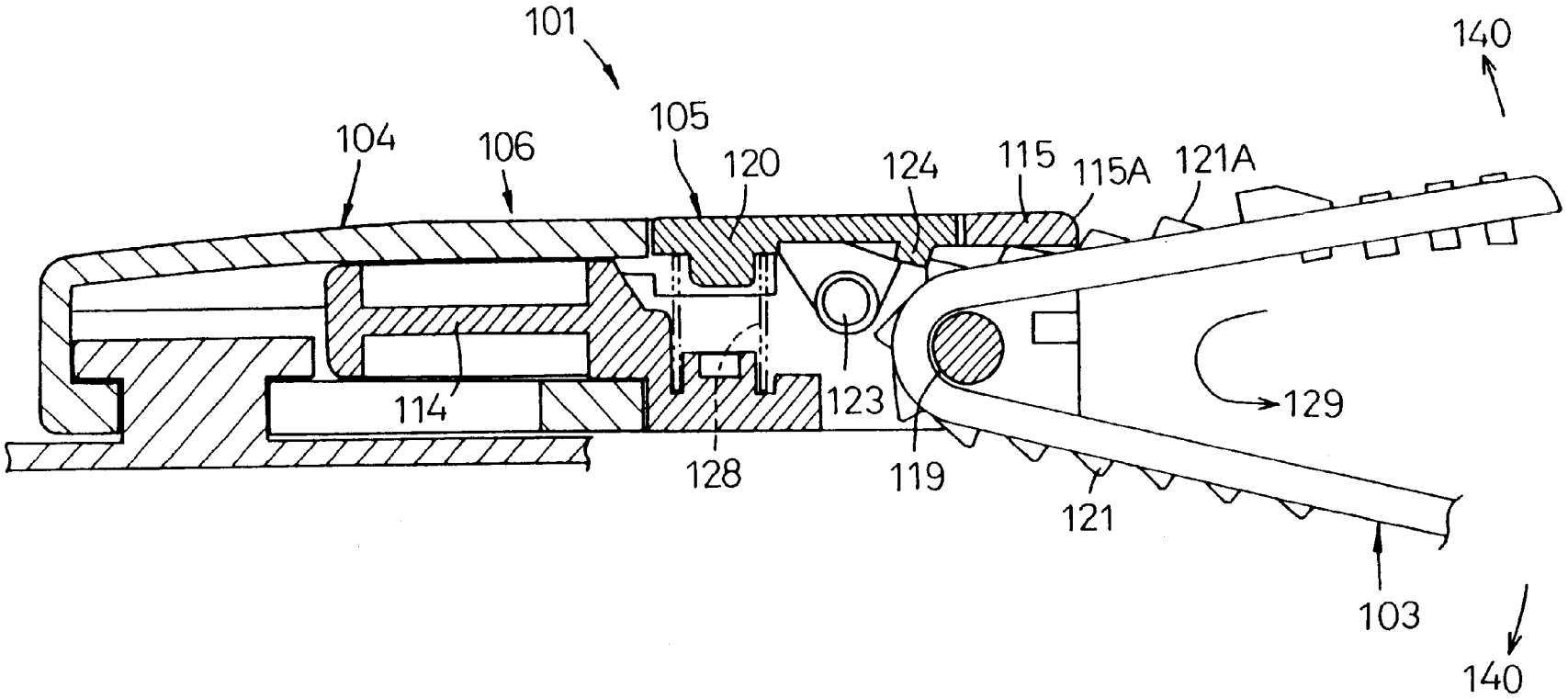
FIG.6 PRIOR ART
FIG. 6 is a sectional view taken along a line VI—VI in FIG. 5.

FIG. 2 is a sectional view taken along a line II—II in FIG. 1 and FIG. 3 is an exploded perspective view of the second coupling member 5. It should be understood here that FIG. 2 shows the strap 3 in a side view. The first coupling member 4 is similar to that of prior art as shown in FIGS. 5 and 6 in that a flange 9 of a locking projection 7 formed integrally with the fin 1 bears from the inner side against a peripheral edge portion of an opening 12C formed in the vicinity of a front end of the first coupling member 4.

The second coupling member 5 has front and rear ends. This second coupling member 5 is formed adjacent its front end with an insert portion 14 adapted to be retractably inserted into the sheath-shaped first coupling member 4 and adjacent its rear end with a holding frame mechanism 15 within which the strap 3 is draped around a pin 19 provided in the holding frame mechanism 15 as its component. The insert 14 has a guide arm 16 and a pair of locking arms 18 extending in parallel to each other with the guide arm 16 therebetween. As the insert 14 is inserted into the first coupling member 4, the guide arm 16 is engaged with a guide groove (not shown) formed in the coupling member 4 and thereby functions as a guide in the direction of insertion. The locking arms 18 are elastically deformed in vertical direction as viewed in FIG. 3 so that distal ends 18A thereof may be releasably engaged with windows 11 (See FIG. 1) formed in the first coupling member 4 and thereby prevent the second coupling member 5 from being unintentionally retracted out from the first coupling member 4. Referring to FIG. 1, the second coupling member 5 can be retracted from the first coupling member 4 by depressing the distal ends 18A of the locking arms 18 inwardly of the first coupling member 4.

The holding frame mechanism 15 of the second coupling member 5 has a frame 30 formed integrally with the insert 14 and a movable locking piece 20 lying inside the frame 30. The frame 30 comprises a top portion 31 and a pair of lateral portions 32 depending from opposite ends of the top portion 31 (See FIG. 4). The top portion 31 is formed with a window 33 adapted to receive the movable locking piece 20 and the respective lateral portions 32 are formed with bearing holes 25. Between the pair of lateral portions 32, a bridge 34 and a rotatable cylindrical pin 19 extend. The movable locking piece 20 has a pair of shafts 23 extending outward from transversely opposite side edges of the piece 20, a plurality of springs 36 extending ahead of the shafts 23 and then curving inwardly of the frame 30, each describing substantially an L-shape, and a second locking tooth 24 formed in the inner surface of the movable locking piece 20 behind the shafts 23. With the movable locking piece 20 received in the window 33, the shafts 23 are rotatably supported by the respective bearing holes 25 and the springs 36 bear against the bridge 34 from above as viewed in FIG. 2.

Referring now to FIG. 2, the rectilinear strap 3 is flexed in U- or V-shape lying on its side with first locking teeth 21 outside and draped around the pin 19 of the second coupling member 5 so that movement of the strap 3 relative to the buckle 6 in a direction indicated by an arrow 29 may slacken the strap 3. In order to prevent the strap 3 from being unintentionally slackened, an arrangement is provided that one of the first locking teeth 21 of the strap 3 bears against the second locking tooth 24 formed on the movable locking piece 20 from the right as viewed in FIG. 2. The strap 3 can be slackened by depressing a front end 20A of the movable locking piece 20 (See FIG. 2). Thereupon, the movable locking piece 20 rotates around the shafts 23 so that the springs 36 bearing against the bridge 34 may be elastically deformed and thereby the second locking tooth 24 may be floated off from one of the first locking teeth 21. In this way, the strap 3 becomes movable in the direction indicated by the arrow 29 as well as in the direction opposite thereto. Referring to FIG. 2, the strap 3 may be pulled in the direction opposite to the direction indicated by the arrow 29 to tighten the strap 3. Thereupon, an inclined rear surface 21A of the first locking tooth 21 bears from below against the second locking tooth 24 and causes the movable locking piece 20 to float against the biasing effect of the springs 36 so that the second locking tooth 24 may be disengaged from the first locking tooth 21.

Figure 4:
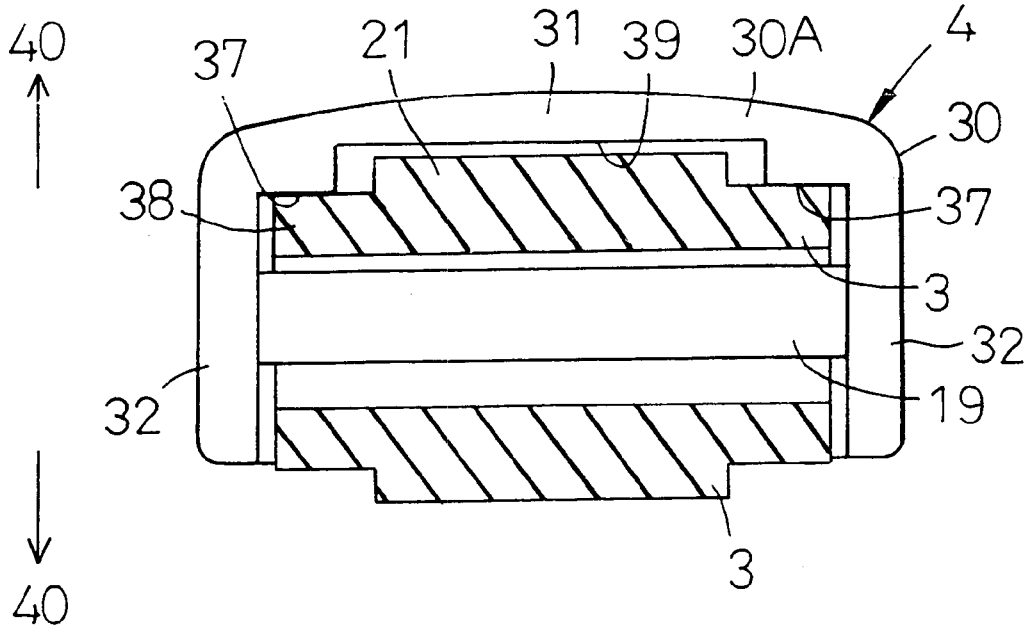
FIG. 4 is a sectional view taken along a line IV—IV in FIG. 1.

FIG. 4 is a sectional view taken along a line IV—IV in FIG. 1 and illustrates sectional shapes of the rear end of the second coupling member 4 and of the draped strap 3. In the coupling member 5, the frame 30 presents, at least in the vicinity of its rear end, an inverted U-shaped section defined by the top portion 31 and the pair of lateral portions 32. Transversely opposite side edge portions 37 of the top portion 31's lower surface are adapted to bear against transversely opposite side edge portions 38 of the strap 3 extending outward beyond the first locking tooth 21. A transversely middle zone 39 of the top portion 31's lower surface is hollowed out by a dimension deeper than a height of the first locking tooth 21 to form a depression opening downward. While the strap 3 draped in U-shape normally tends to move elastically in directions indicated by arrows 40 in FIGS. 2 and 4 to restore its initial rectilinear state, it is not apprehended that the first locking tooth 21 might come in tight contact with the lower-surface of the top portion 31 and/or the rear end of the top portion 31, i.e., a rear end 30A of the frame 30, even if the side edge portions 38 of the strap 3 bears against the side edge portions 37 of the top portion 31. This is because that the side edge portions 38 of the strap 3 can smoothly slide along the side edge portions 37 of the holding frame mechanism 30 and the strap 3 can smoothly move in the direction indicated by the arrow 29 as well as in the direction opposite thereto. In this manner, this invention can solve the problem left unsolved behind by the combination of buckle and strap of the prior art such that the locking teeth formed on the strap bears against the rear end of the buckle and prevents the strap from smoothly moving in its longitudinal direction.

The combination of buckle and strap according to this invention is characterized by a unique arrangement such that the top portion of the holding frame mechanism has its inner surface hollowed out by a dimension sufficient to avoid the anxiety that the locking tooth formed on the strap might bear against the holding frame mechanism as the strap moves in its longitudinal direction. This unique arrangement ensures that the strap can smoothly move in its longitudinal direction.

What is claimed is:

1. A combination of strap and buckle adapted to couple a heel strap to a foot pocket and at the same time to adjustably tighten said strap around a diver's heel, wherein:

said strap is formed on its one surface a plurality of first locking teeth arranged intermittently in a longitudinal direction of said strap, each of said first locking teeth extending in a transverse direction of said strap so as to leave transversely opposite side edge portions of said strap free from any tooth;

said buckle comprises a sheath-shaped first coupling member and a second coupling member releasably engaged with said first coupling member and having front and rear ends, wherein said second coupling member comprises an insert portion formed adjacent said front end so as to be releasably engaged with said first coupling member and a holding frame mechanism formed adjacent said rear end within which said strap is draped around so as to be movable in the longitudinal direction of said strap;

said holding frame mechanism includes a movable locking piece pivotally supported by said holding frame mechanism, wherein said movable locking-piece has a second locking tooth normally biased by springs to bear against said first locking tooth and thereby to prevent said strap from moving in a direction in which said strap is slackened and pivotally moved upward away from said first locking tooth against the biasing effect of said springs, allowing said strap to move in a direction in which said strap is tightened, as said strap is pulled in the direction in which said strap is tightened; and in the vicinity of said rear end, said holding frame mechanism presents an inverted U-shaped section defined by a top portion and a pair of lateral portions depending from transversely opposite side edges of said top portion wherein a pin around which said strap is draped extends between said pair of lateral portions below said top portion and a lower surface of said top portion has transversely opposite side edge portions bears against said strap disposed between said lower surface and said pin so that the transversely opposite side edge portions of said strap extending outside said first locking teeth may slidably move and transversely middle zone of said lower surface of said top portion is hollowed out upward by a dimension deeper than a height of said first locking teeth so that said first locking teeth can move in the longitudinal direction of said strap.

* * * * *